US009302497B2

(12) United States Patent
Hayashi et al.

(10) Patent No.: US 9,302,497 B2
(45) Date of Patent: Apr. 5, 2016

(54) OPTICAL WRITING DEVICE, IMAGE FORMING APPARATUS, AND METHOD OF CONTROLLING OPTICAL WRITING DEVICE

(71) Applicants: Masayuki Hayashi, Osaka (JP); Yoshinori Shirasaki, Osaka (JP); Kunihiro Komai, Osaka (JP); Hiroaki Ikeda, Osaka (JP); Takeshi Shikama, Osaka (JP); Akinori Yamaguchi, Osaka (JP); Takuhei Yokoyama, Osaka (JP); Motohiro Kawanabe, Osaka (JP); Tatsuya Miyadera, Osaka (JP)

(72) Inventors: Masayuki Hayashi, Osaka (JP); Yoshinori Shirasaki, Osaka (JP); Kunihiro Komai, Osaka (JP); Hiroaki Ikeda, Osaka (JP); Takeshi Shikama, Osaka (JP); Akinori Yamaguchi, Osaka (JP); Takuhei Yokoyama, Osaka (JP); Motohiro Kawanabe, Osaka (JP); Tatsuya Miyadera, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 358 days.

(21) Appl. No.: 13/683,248

(22) Filed: Nov. 21, 2012

(65) Prior Publication Data

US 2014/0139607 A1 May 22, 2014

(30) Foreign Application Priority Data

Nov. 24, 2011 (JP) ..... 2011-256296

(51) Int. Cl.

| | |
|---|---|
| ***B41J 2/45*** | (2006.01) |
| ***G03G 15/043*** | (2006.01) |
| ***G03G 15/04*** | (2006.01) |
| ***G03G 21/08*** | (2006.01) |

(52) U.S. Cl.

CPC ..... *B41J 2/45* (2013.01); *G03G 15/043* (2013.01); *G03G 15/04054* (2013.01); *G03G 21/08* (2013.01)

(58) Field of Classification Search

CPC ..... B41J 2/45; B41J 2/47
USPC ..... 347/118, 130, 140, 232, 240, 251
See application file for complete search history.

(56) References Cited

U.S. PATENT DOCUMENTS

| | | | | |
|---|---|---|---|---|
| 5,257,072 | A | 10/1993 | Maeda | |
| 5,697,013 | A | 12/1997 | Sasaki | |
| 2009/0297176 | A1 * | 12/2009 | Haruyama | 399/27 |

FOREIGN PATENT DOCUMENTS

| | | |
|---|---|---|
| JP | 64-063990 | 3/1989 |
| JP | 04-309988 | 11/1992 |
| JP | 08-234646 | 9/1996 |
| JP | 2008-023732 | 2/2008 |

* cited by examiner

*Primary Examiner* — Kristal Feggins
*Assistant Examiner* — Kendrick Liu
(74) *Attorney, Agent, or Firm* — Oblon, McClelland, Maier & Neustadt, L.L.P.

(57) ABSTRACT

An optical writing device is configured to form electrostatic latent images on a plurality of photosensitive elements by a plurality of light sources. The optical writing device includes: an image-data acquiring section that acquires image data; and a light-source control section that performs light-emission control on the light source based on pixel data generated from acquired image data, and also performs a neutralization process on the photosensitive element by controlling the light source to expose the photosensitive element to light. In the neutralization process, the light-source control section divides a period during which light-on/off control can be performed on the light source, into sub-periods based on pixel data input to the light-source control section, and causes the light sources to be lit in any one of the sub-periods so as to always place at least one of the plurality of light sources in a light-off state.

8 Claims, 5 Drawing Sheets

OPTICAL WRITING DEVICE, IMAGE FORMING APPARATUS, AND METHOD OF CONTROLLING OPTICAL WRITING DEVICE

CROSS-REFERENCE TO RELATED APPLICATIONS

The present application claims priority to and incorporates by reference the entire contents of Japanese Patent Application No. 2011-256296 filed in Japan on Nov. 24, 2011.

BACKGROUND OF THE INVENTION

1. Field of the Invention

The present invention relates to an optical writing device, an image forming apparatus, and a method of controlling an optical writing device.

2. Description of the Related Art

There has been a growing trend in recent years to computerize information. This trend makes an image processing apparatus, such as a printer and a facsimile used to output computerized information and a scanner used to computerize a document, indispensable equipment. Such an image processing apparatus often has an image capturing function, an image forming function, a communication function, and the like so as to be configured as a multifunction peripheral operable as a printer, a facsimile, a scanner and a copier.

An electrophotographic image forming apparatus is widely used as an image forming apparatus, which is one type of such an image processing apparatus, for use in outputting a computerized document. An electrophotographic image forming apparatus produces a printout by exposing a photosensitive element to light to thereby form an electrostatic latent image, forming a toner image by developing the electrostatic latent image with a developer such as toner, and transferring the toner image onto paper.

A method of performing exposure of a photosensitive element by an optical writing device included in an electrophotographic image forming apparatus includes a laser diode (LD) raster optical system method and a light emitting diode (LED) writing method. When an optical writing device uses the LED writing method, the optical writing device includes an LED array (LEDA) head on which LEDs each associated with one of pixels of one main scanning line are arranged in an array.

An electrophotographic optical writing device generally performs a neutralization process each time one print job is completed. The neutralization process makes a charged state of a photosensitive element at the time of starting a next print job uniform so that unevenness in amount of toner clinging to the photosensitive element is suppressed to maintain image quality (see Japanese Patent Application Laid-open No. 8-234646, for example).

Conventionally, an optical writing device that uses the LD raster optical system has been mainstream. When the LD raster optical system is used, exposure of an entire surface of a photosensitive element can be performed by keeping an LD light source lit; in this case, maximum electric current is unaffected. In contrast, when the LED writing method is used, it is necessary to cause all LEDs contained in an LEDA head to emit light to perform exposure of an entire surface of a photosensitive element.

Total light quantity for use in optical writing using an LED head is regulated, and control is performed in normal writing control so as to prevent a situation where all LEDs on one main scanning line light up concurrently. Therefore, an amount of electric current necessary for the normal writing control is smaller than an amount of electric current that flows to cause all the LEDs contained in the LED head to emit light. However, to perform a neutralization process as described above, a power source unit and a circuit of a capacity appropriate for an amount of electric current that is not necessary for the normal writing control become necessary because the neutralization process involves lighting up all the LEDs. This not only increases apparatus costs but also makes an apparatus configuration inefficient.

The problem described above is not a problem of only an optical writing device that uses an LED head but can be a problem of any optical writing device that performs exposure of a photosensitive element using a light-source element array made up of a plurality of light-source elements as well.

There is a need to reduce a maximum amount of electric current necessary for a neutralization process in an optical writing device that performs exposure of photosensitive elements using light-source element arrays each made up of a plurality of light-source elements.

SUMMARY OF THE INVENTION

It is an object of the present invention to at least partially solve the problems in the conventional technology.

An optical writing device is configured to form electrostatic latent images on a plurality of photosensitive elements. The optical writing device includes: a plurality of light sources, each of the light sources including a plurality of light source elements arranged in an array, and being configured to form an electrostatic latent image on corresponding one of the photosensitive elements; an image-data acquiring section that acquires image data that is data about an image to be formed as an electrostatic latent image; and a light-source control section that performs light-emission control on the light source based on pixel data generated from acquired image data, and also performs a neutralization process to neutralize electrical charge on the photosensitive element by controlling the light source to expose the photosensitive element to light. In the neutralization process, the light-source control section divides a period during which light-on/off control can be performed on the light source, into sub-periods based on pixel data input to the light-source control section, and causes the light sources to be lit in any one of the sub-periods so as to always place at least one of the plurality of light sources in a light-off state.

An image forming apparatus includes an optical writing device. The optical writing device is configured to form electrostatic latent images on a plurality of photosensitive elements, and includes: a plurality of light sources, each of the light sources including a plurality of light source elements arranged in an array, and being configured to form an electrostatic latent image on corresponding one of the photosensitive elements; an image-data acquiring section that acquires image data that is data about an image to be formed as an electrostatic latent image; and a light-source control section that performs light-emission control on the light source based on pixel data generated from acquired image data, and also performs a neutralization process to neutralize electrical charge on the photosensitive element by controlling the light source to expose the photosensitive element to light. In the neutralization process, the light-source control section divides a period during which light-on/off control can be performed on the light source, into sub-periods based on pixel data input to the light-source control section, and causes the light sources to be lit in any one of the sub-periods so as to always place at least one of the plurality of light sources in a light-off state.

A method is of controlling an optical writing device configured to form electrostatic latent images on a plurality of photosensitive elements. The optical writing device includes: a plurality of light sources, each of the light sources including a plurality of light source elements arranged in an array, and being configured to form an electrostatic latent image on corresponding one of the photosensitive elements; an image-data acquiring section that acquires image data that is data about an image to be formed as an electrostatic latent image; and a light-source control section that performs light-emission control on the light source based on pixel data generated from acquired image data, and also performs a neutralization process to neutralize electrical charge on the photosensitive element by controlling the light source to expose the photosensitive element to light. The control method includes: in the neutralization process, dividing a period during which light-on/off control can be performed on the light source, into sub-periods based on pixel data input to the light-source control section; and causing the light sources to be lit in any one of the sub-periods so as to always place at least one of the plurality of light sources in a light-off state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention is described in detail below with reference to the accompanying drawings. In the present embodiment, a multifunction peripheral (MFP) is exemplified as an image forming apparatus. The image forming apparatus is not necessarily an MFP, and can be a copier, a printer, a facsimile, or the like.

Figure 1:
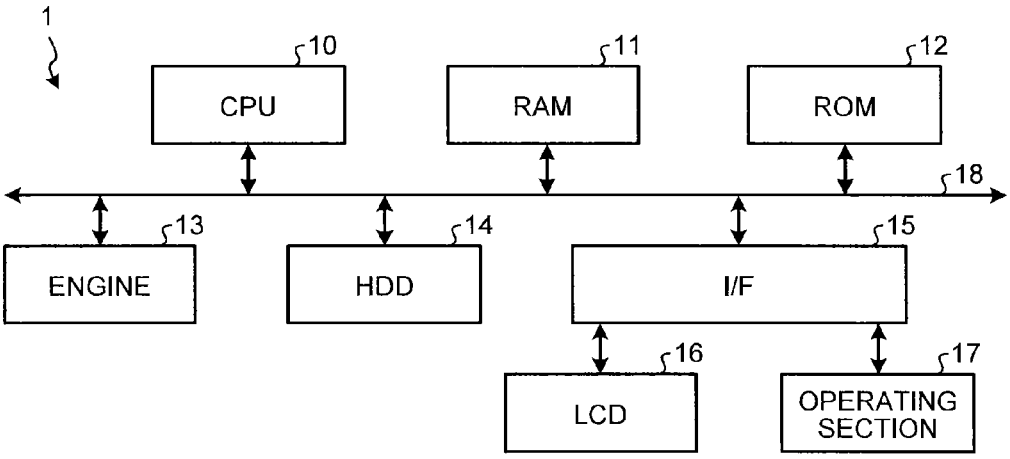
FIG. 1 is a block diagram illustrating a hardware configuration of an image forming apparatus according to an embodiment of the present invention.

FIG. 1 is a block diagram illustrating a hardware configuration of an image forming apparatus 1 according to the present embodiment. As illustrated in FIG. 1, the image forming apparatus 1 according to the present embodiment has a configuration similar to that of a general information processing terminal such as a server or a personal computer (PC) and additionally includes an engine that forms an image. More specifically, the image forming apparatus 1 according to the present embodiment includes a central processing unit (CPU) 10, a random access memory (RAM) 11, a read only memory (ROM) 12, an engine 13, a hard disk drive (HDD) 14, and an interface (I/F) 15 that are connected to one another via a bus 18. A liquid crystal display (LCD) 16 and an operating section 17 are connected to the I/F 15.

The CPU 10 is an arithmetic unit that controls operations of the overall image forming apparatus 1. The RAM 11 is a volatile storage medium from and to which information can be read and written at high speed and which is used as a working area by the CPU 10 when the CPU 10 performs information processing. The ROM 12 is a read-only nonvolatile storage medium in which a program such as firmware is stored. The engine 13 is a mechanism that practically performs image formation in the image forming apparatus 1.

The HDD 14 is a nonvolatile storage medium from and to which information can be read and written. An operating system (OS), various types of control programs, an application program, and the like are stored in the HDD 14. The I/F 15 connects the bus 18 with various types of hardware, a network, and the like and controls this connection. The LCD 16 is a visual user interface that allows a user to check a status of the image forming apparatus 1. The operating section 17 is a user interface such as a keyboard and a mouse to be used by a user to input information to the image forming apparatus 1.

In such a hardware configuration, the CPU 10 performs an operation according a program stored in a storage medium, such as the ROM 12, the HDD 14, and an optical disk (not shown), and loaded into the RAM 11, thereby forming a software control section. A functional block that implement a function of the image forming apparatus 1 according to the present embodiment is provided by a combination of the software control section configured as described above and hardware.

Figure 2:
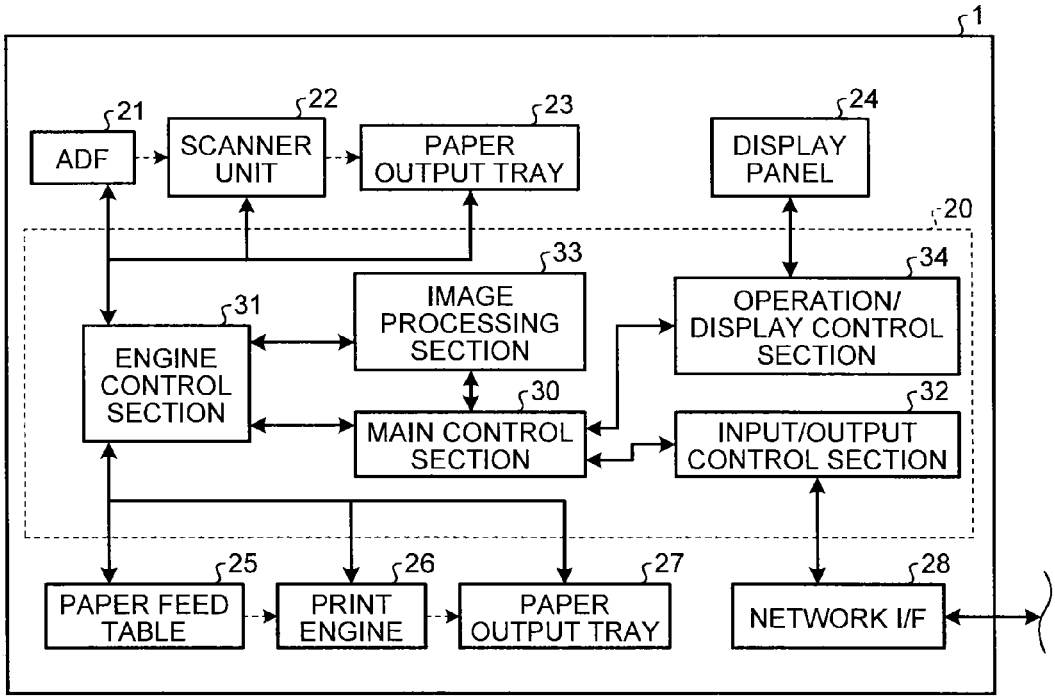
FIG. 2 is a diagram illustrating a functional configuration of the image forming apparatus according to the embodiment.

A functional configuration of the image forming apparatus 1 according to the embodiment is described below with reference to FIG. 2. FIG. 2 is a block diagram illustrating the functional configuration of the image forming apparatus 1 according to the present embodiment. As illustrated in FIG. 2, the image forming apparatus 1 according to the present embodiment includes a controller 20, an automatic document feeder (ADF) 21, a scanner unit 22, a paper output tray 23, a display panel 24, a paper feed table 25, a print engine 26, a paper output tray 27, and a network I/F 28.

The controller 20 includes a main control section 30, an engine control section 31, an input/output control section 32, an image processing section 33, and an operation/display control section 34. As illustrated in FIG. 2, the image forming apparatus 1 according to the present embodiment is configured as an MFP that includes the scanner unit 22 and the print engine 26. In FIG. 2, electrical connections are indicated by solid-line arrows, while flows of paper are indicated by broken-line arrows.

The display panel 24 serves as an output interface that visually displays a status of the image forming apparatus 1 and also as an input interface (operating section) used as a touch panel by a user when the user directly operates the image forming apparatus 1 or inputs information to the image forming apparatus 1. The network I/F 28 is an interface that allows the image forming apparatus 1 to carry out communications via a network with other equipment. An Ethernet (registered trademark) or universal serial bus (USB) interface is used as the network I/F 28.

The controller 20 consists of a combination of software and hardware. More specifically, the controller 20 includes a software control section and hardware such as an integrated circuit. The software control section is implemented by control of the CPU 10 according to a control program such as firmware that is stored in the ROM 12, a nonvolatile memory, or a nonvolatile storage medium such as the HDD 14 or the optical disk and loaded into a volatile memory (hereinafter, "memory") such as the RAM 11. The controller 20 functions as a control section that controls the overall image forming apparatus 1.

The main control section 30 performs a function of controlling sections contained in the controller 20 and provides instructions to the sections of the controller 20. The engine control section 31 performs a function as a driving section that controls or drives the print engine 26, the scanner unit 22, and the like. The input/output control section 32 inputs a signal and an instruction having been input via the network I/F 28, to the main control section 30. The main control section 30 accesses other equipment via the network I/F 28 by controlling the input/output control section 32.

The image processing section 33 generates drawing data from print data contained in a print job input to the image forming apparatus 1, under control of the main control section 30. This drawing data is data based on which the print engine 26, which is an image forming unit, draws an image to be formed in an image forming operation. The drawing data is information about pixels constituting the image to be output, or, put another way, pixel data. The print data contained in the print job is image data converted by a printer driver installed on an information processing apparatus such as a PC, into a format recognizable to the image forming apparatus 1. The operation/display control section 34 causes the display panel 24 to display information or transmits information input via the display panel 24, to the main control section 30.

When the image forming apparatus 1 works as a printer, first, the input/output control section 32 receives a print job via the network I/F 28. The input/output control section 32 transfers the received print job to the main control section 30. On receiving the print job, the main control section 30 controls the image processing section 33, thereby causing the image processing section 33 to generate drawing data from print data contained in the print job.

After the drawing data is generated by the image processing section 33, the engine control section 31 forms an image on paper fed from the paper feed table 25, based on the drawing data. In other words, the print engine 26 functions as an image forming unit. The paper on which the image is formed by the print engine 26 is ejected onto the paper output tray 27.

Figure 3:
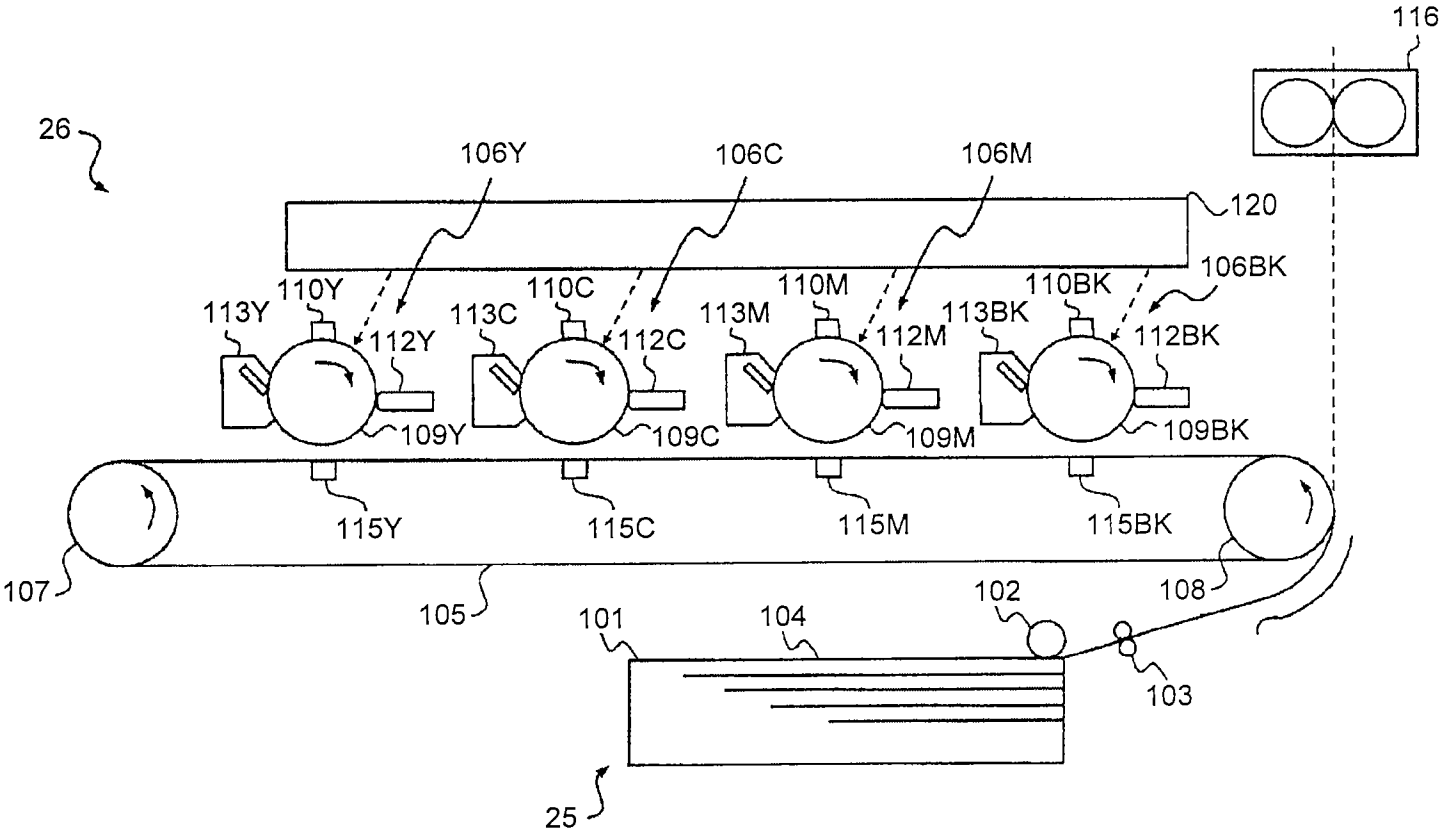
FIG. 3 is a diagram illustrating a configuration of a print engine according to the embodiment.

A configuration of the print engine 26 according to the present embodiment is described below with reference to FIG. 3. As illustrated in FIG. 3, the print engine 26 according to the present embodiment is what is generally called as a tandem print engine configured such that image forming sections 106 for respective colors are arranged along a carriage belt 105 which is an endless-type conveying unit. More specifically, the plurality of image forming sections (electrophotography processing sections) 106BK, 106M, 106C, and 106Y are arranged along the carriage belt 105 in this order from upstream with respect to a conveying direction of the carriage belt 105. The carriage belt 105 is an intermediate transfer belt on which an intermediate transfer image is to be formed. The intermediate transfer image is to be transferred onto paper (an example of a recording medium) 104 picked up and fed from a paper feed tray 101 by a paper feed roller 102 and a separation roller 103.

Figure 4:
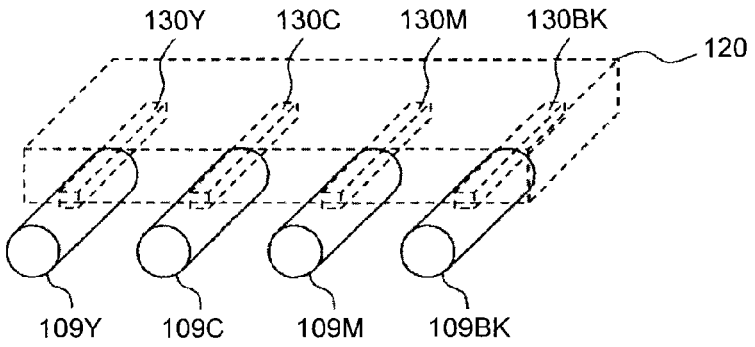
FIG. 4 is a diagram schematically illustrating a configuration of an optical writing device according to the embodiment.

The plurality of image forming sections 106BK, 106M, 106C, and 106Y are identical in an internal configuration except that colors of toner images to be formed by the image forming sections differ from one another. The image forming section 106BK forms a black image; the image forming section 106M forms a magenta image; the image forming section 106C forms a cyan image; the image forming section 106Y forms a yellow image. The image forming section 106BK is specifically described below. Because the other image forming sections 106M, 106C, and 106Y are similar to the image forming section 106BK, components of the other image forming sections 106M, 106C, and 106Y are indicated in FIGS. 3 and 4 using symbols having corresponding one symbol of M, C, and Y appended in place of BK appended to symbols of corresponding components of the image forming section 106BK, and their explanation is omitted.

The carriage belt 105 is an endless belt supported by and wound around a driving roller 107 that is driven to rotate and a driven roller 108. The driving roller 107 is driven to rotate by a driving motor (not shown). The driving motor, the driving roller 107, and the driven roller 108 function as a driving unit that moves the carriage belt 105 which is an endless conveying unit.

In image formation, the image forming section 106BK, which performs image formation first, transfers a black toner image onto the carriage belt 105 that is driven to rotate. The image forming section 106BK includes a photosensitive drum 109BK which is a photosensitive element, and an electrostatic charging device 110BK, an optical writing device 200, a developing unit 112BK, and a photosensitive-element cleaner 113BK arranged around the photosensitive drum 109BK. The optical writing device 200 is configured to illuminate each of the photosensitive drums 109BK, 109M, 109C, and 109Y (hereinafter, collectively referred to as the "photosensitive drum 109") with light.

When image formation is performed, an outer peripheral surface of the photosensitive drum 109BK is uniformly electrostatically charged in the dark by the electrostatic charging device 110BK, and thereafter subjected to optical writing performed by the optical writing device 200 with light emitted from a light source for a black image. As a result, an electrostatic latent image is formed. The developing unit 112BK develops this electrostatic latent image with black toner, thereby forming a black toner image on the photosensitive drum 109BK.

A transfer device 115BK transfers this toner image onto the carriage belt 105 at a position (transfer position) where the photosensitive drum 109BK comes in contact with or comes closest to the carriage belt 105. As a result of this transfer, a black toner image is formed on the carriage belt 105. The photosensitive drum 109BK from which the toner image has been transferred is wiped by a photosensitive-element cleaner 113BK to remove unnecessary toner remaining on the outer peripheral surface therefrom, thereby made ready for next image formation.

The black toner image transferred onto the carriage belt 105 by the image forming section 106BK as described above is conveyed to the next image forming section 106M by roller drive of the carriage belt 105. The image forming section 106M performs an image forming process similar to that performed by the image forming section 106BK to form a magenta toner image on the photosensitive drum 109M. The magenta toner image is transferred to be overlaid on the already-formed black image.

The black and magenta toner images transferred onto the carriage belt 105 are further conveyed to the next image forming sections 106C and 106Y where a cyan toner image formed on the photosensitive drum 109C and a yellow toner image formed on the photosensitive drum 109Y are transferred to be overlaid on the already-transferred toner images. Thus, a full-color intermediate transfer image is formed on the carriage belt 105.

The paper 104 housed in the paper feed tray 101 is fed one sheet by one sheet from an uppermost sheet. The intermediate transfer image formed on the carriage belt 105 is transferred onto a surface of the paper 104 at a position where a conveying path of the paper 104 comes in contact with or comes closest to the carriage belt 105. As a result, an image is formed on the surface of the paper 104. The paper 104 with the image formed on its surface is further conveyed to a fixing device 116 where the image is fixed. Thereafter, the paper 104 is ejected to the outside of the image forming apparatus.

The optical writing device 120 according to the present embodiment is described below. FIG. 4 is a diagram illustrating a positional relation between the optical writing device 120 and the photosensitive drums 109 according to the present embodiment. As illustrated in FIG. 4, illumination light emitted onto the photosensitive drums 109BK, 109M, 109C, and 109Y is emitted from LED arrays (LEDAs) 130BK, 130M, 130C, and 130Y, respectively, (hereinafter, collectively referred to as the "LEDA 130") which each are a light source.

The LEDA 130 includes LEDs which each are a light-emitting element and are arranged in a main-scanning direction of the photosensitive drum 109. A control section contained in the optical writing device 120 controls light-on/off state of each of the LEDs arranged in the main-scanning direction based on drawing data input from the controller 20 for each main-scanning line, thereby selectively exposing a surface of the photosensitive drum 109 to light to form an electrostatic latent image. In the present embodiment, an example is explained in which an LED is used as a light source; however, it is not limited to the LED light source. The present embodiment is similarly applicable to any light-source element array made up of light-source elements arranged in the main-scanning direction.

The optical writing device 120 according to the present embodiment performs, in addition to exposure for optical writing in such an image-forming output process as described above, exposure for neutralization of the photosensitive drums 109. Control related to this exposure for neutralization is an essence of the present embodiment.

Figure 5:
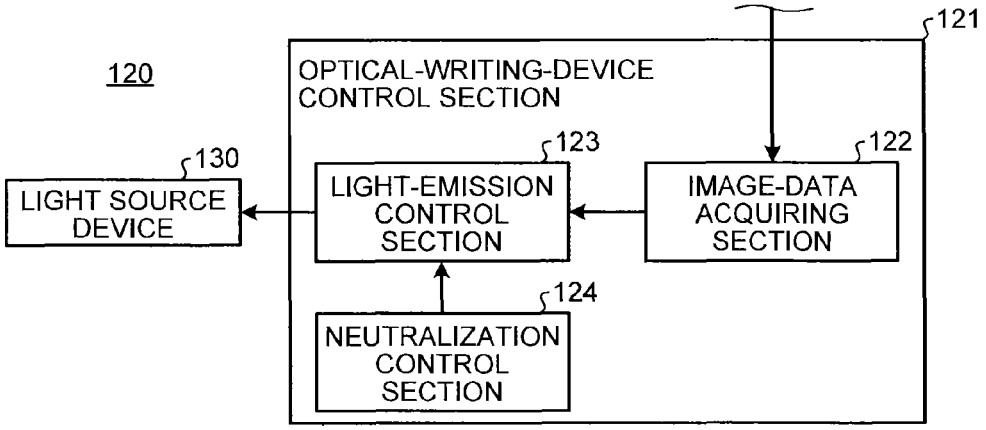
FIG. 5 is a block diagram illustrating a control section of the optical writing device according to the embodiment.

Control blocks of the optical writing device 120 according to the present embodiment are described below with reference to FIG. 5. FIG. 5 is a diagram illustrating a functional configuration of an optical-writing-device control section 121 that controls the optical writing device 120 according to the present embodiment, and connection between the optical-writing-device control section 121 and the LEDA 130. As illustrated in FIG. 5, the optical-writing-device control section 121 according to the present embodiment includes an image-data acquiring section 122, a light-emission control section 123, and a neutralization control section 124.

The optical writing device 120 according to the present embodiment includes an information processing system as described above with reference to FIG. 1 that includes the CPU 10, the RAM 11, the ROM 12, and the HDD 14. The optical-writing-device control section 121 illustrated in FIG. 5 consists of a combination of hardware and a software control section implemented, as in a case of the controller 20 of the image forming apparatus 1, by operations of the CPU 10 according to a control program that is stored in the ROM 12 or the HDD 14 and loaded onto the RAM 11.

The image-data acquiring section 122 acquires image data input from the controller 20 and performs various processing on the image data, thereby generating data of pixels that constitute an image to be formed, and inputs the data of pixels to the light-emission control section 123. Examples of processing performed by the image-data acquiring section 122 include color processing depending on characteristics of the optical writing device 120 and processing of adjusting image density.

The light-emission control section 123 is a light-source control section that controls light emission from the LEDAs 130 based on image data input from the image-data acquiring section 122 according to a horizontal synchronization signal for synchronization in a sub-scanning direction. The light-emission control section 123 performs light-on/off control of the LEDA 130 one line by one line according to the horizontal synchronization signal. The light-emission control section 123 according to the present embodiment performs light-on/off control of the LEDs for one line for each of groups into which the LEDs for one line is grouped, with a sub-cycle period obtained by dividing a cycle period of the horizontal synchronization signal, rather than performing light-on/off control of all the LEDs for one line at once.

Figure 6:
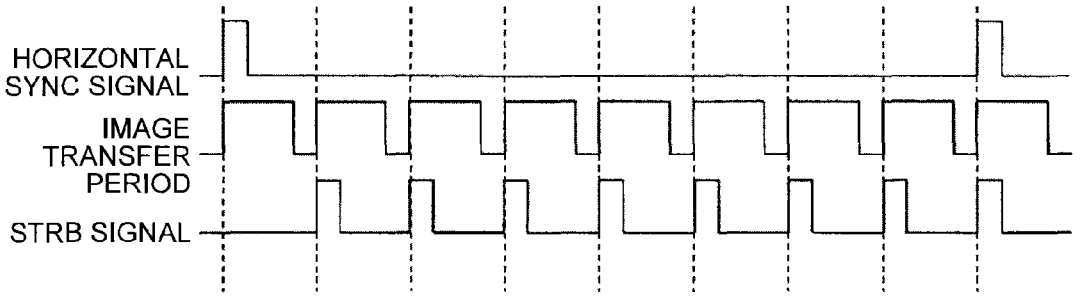
FIG. 6 is a timing diagram illustrating light emission timing of an LEDA according to the embodiment.

FIG. 6 is a timing diagram illustrating an example of the light-on/off control according to the embodiment. As described above, the light-emission control section 123 according to the present embodiment performs light emission control of the LEDs for one line according to the horizontal synchronization signal. At this time, the light-emission control section 123 performs light-on/off control for each of the groups into which the LEDs for one line are divided, with the sub-cycle period.

As shown by rises of an image transfer signal in FIG. 6, the image-data acquiring section 122 according to the present embodiment performs image transfer to the light-emission control section 123 with an image transfer cycle period that is one-eighth of the cycle period of the horizontal synchronization signal. One high period of this image transfer signal corresponds to a transfer period during which an image signal to control light-on/off of the LEDs contained in one of the groups is transferred.

The light-emission control section 123 performs light emission control on the LEDs of a group for which the image signal has been transferred, in a period after an end of one high period of the image transfer signal before an end of next high period of the image transfer signal, in response to a rise of an STRB signal. This light-emission control operation is performed eight times in each cycle period of the horizontal synchronization signal.

The light-emission control section 123 performs light emission control according to rises of the STRB signal timings of which are set for each of the LEDAs 130. Timings when STRB signals of the respective LEDAs 130 rise are adjusted so that toner images of the respective colors are transferred onto the carriage belt 105 without misregistration. The timings of the STRB signals of the respective LEDAs 130 are adjusted in a registration process that is performed at predetermined intervals.

The registration process is a process of reading a registration pattern formed on the carriage belt 105 and adjusting timings when the STRB signals rise so that patterns of the respective colors are spaced at predetermined intervals, as in a normal image forming process.

Figure 7:
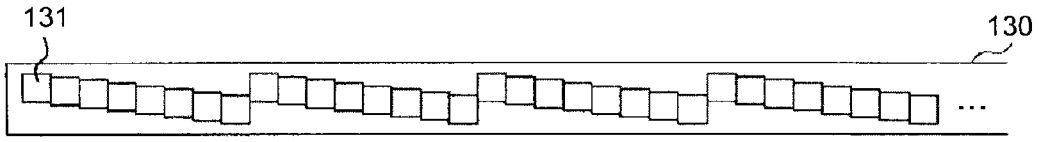
FIG. 7 is a diagram illustrating an arrangement of LEDs in the LEDA according to the embodiment.

FIG. 7 is a diagram schematically illustrating the LEDA 130 according to the present embodiment for illustration of arrangement of the LEDs in the LEDA 130. As illustrated in FIG. 7, a plurality of LEDs 131 are arranged in the main-scanning direction or, put another way, in a left and right direction of FIG. 7, in the LEDA 130 according to the present embodiment. The plurality of LEDs 131 are arranged such that positions, in a direction perpendicular to the sub-scanning direction, of the LEDs 131 adjacent in the sub-scanning direction are shifted stepwise and return to a previous position every eight LEDs. This arrangement adapts to the light-on/off timing described above with reference to FIG. 6.

Figure 8:
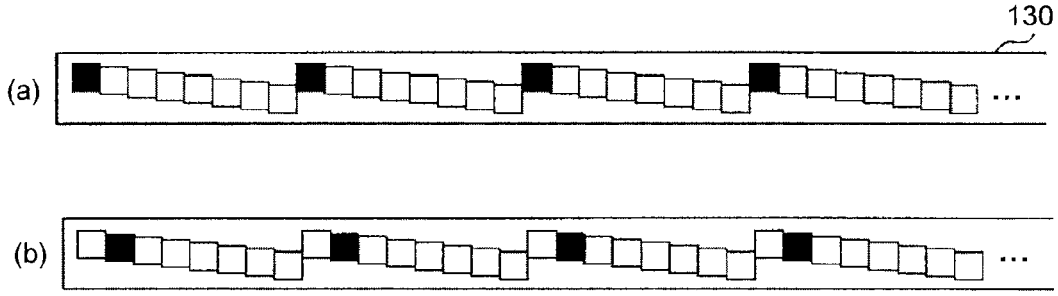
FIG. 8 is a diagram illustrating a way to light-up the LEDs in the LEDA according to the embodiment.

FIGS. 8(*a*) and 8(*b*) are diagrams illustrating a way to light-up the LEDs 131 in the LEDA 130. Targets of light-emission control are indicated by the painted out LEDs 131. FIG. 8(*a*) is a diagram illustrating a way to light-up the LEDs 131 at a time 6*a* in FIG. 6. As illustrated in FIG. 8(*a*), the LEDs 131 at one end of the stepwise shifted eight LEDs 131 is subjected to light-on/off control at the time 6*a* in FIG. 6 or, in other words, in a first one of eight sub-cycle periods into which the cycle period of the horizontal synchronization signal is equally divided.

FIG. 8(*b*) is a diagram illustrating a way to light-up the LEDs 131 at a time 6*b* illustrated in FIG. 6. As illustrated in FIG. 8(*b*), the light-on/off control is performed so as to cause the LEDs 131 each arranged adjacent to corresponding one of the LEDs 131 that are subjected to light-on/off control in the first one of the eight sub-cycle periods are subjected to light-on/off control at the time 6*b* illustrated in FIG. 6 or, in the other words, in a second one of the eight sub-cycle periods. When this control scheme and arrangement of the LEDs 131 described above are employed, an image can be formed without misregistration in the sub-scanning direction in spite of the time-shifted light-on/off control illustrated in FIG. 6.

Note that the targets of the light-on/off control are indicated by the painted out LEDs in FIGS. 8(*a*) and 8(*b*), the painted out LEDs are not always to be lit. More specifically, each of the painted out LEDs 131 which are the targets of the light-on/off control is lit only when a pixel corresponding to that LED 131 is to be colored according to an image to be formed. Furthermore, total quantity of light to be emitted from the optical writing device 120 according to the present embodiment is regulated, and thus control is performed so as to prevent a situation where all the LEDs 131 that are the targets of the light-on/off control light up concurrently at each of light-on times indicated by 6*a* and 6*b* in FIG. 6.

Total light quantity regulation described above is realized by that the image-data acquiring section 122 processes image data so as to, for example, prevent a situation where all of the eight LEDs 131 of each of th groups into which the LEDs 131 are divided as illustrated in FIGS. 8(*a*) and 8(*b*) light up concurrently.

The neutralization control section 124 performs control when the optical writing device 120 performs exposure for neutralization (hereinafter, a "neutralization process"). In the neutralization process, instead of the image-data acquiring section 122, the neutralization control section 124 provides the light-emission control section 123 with data which corresponds to image data, that is, data according to which the LEDAs 130 are lit. The neutralization control section 124 also stores an operation setting value for use by the light-emission control section 123 in the neutralization process, and makes operation settings of the light-emission control section 123 when the neutralization process is performed.

Figure 9:
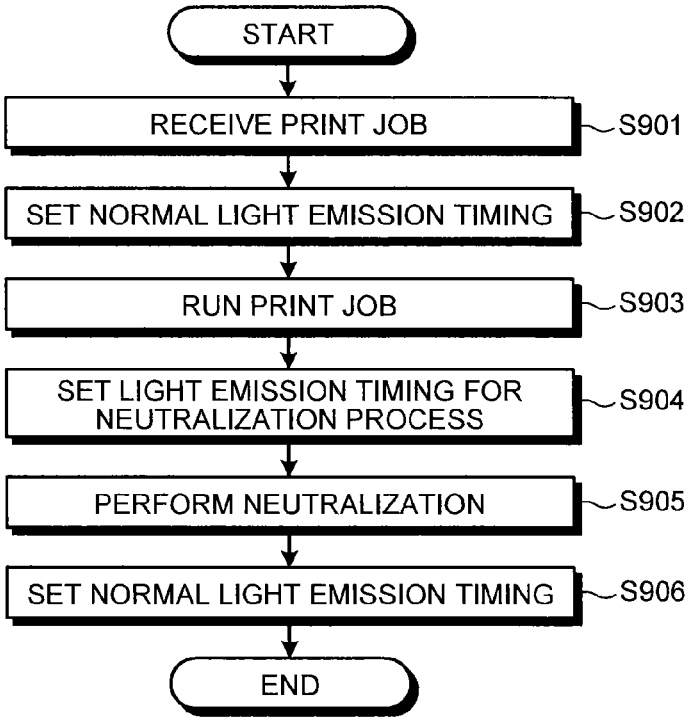
FIG. 9 is a flowchart of operation performed by the image forming apparatus according to the embodiment.

An essence of the present embodiment configured in this way lies in operation settings of the light-emission control section 123 in the neutralization process. The neutralization process according to the present embodiment is described below. FIG. 9 is a flowchart of operation performed by the image forming apparatus 1 according to the present embodiment. As illustrated in FIG. 9, when the image forming apparatus 1 receives a print job (S901), the print engine 26 starts execution of the print job under control of the controller 20.

In the print engine 26, the light-emission control section 123 of the optical-writing-device control section 121 sets normal light emission timings described above with reference to FIG. 6 (S902), and controls light emission from the LEDAs 130 according to input image data, thereby running the print job (S903).

When the single print job is completed, the neutralization control section 124 sets light emission timings for the neutralization process (S904). Thereafter, the light-emission control section 123 performs the neutralization process (S905) and resets settings back to settings for the normal light emission timings (S906). Processing then ends. The light emission timings for the neutralization process that are to be set at S904 are described below with reference to FIG. 10.

As descried above, in a normal image-forming output process, timings of the STRB signals are adjusted so that toner images formed on the photosensitive drums 109 of the respective colors are overlaid on one another without misregistration when transferred onto the carriage belt 105. In contrast thereto, development and transfer of the toner images are not performed in the neutralization process, and thus it is unnecessary to perform registration of exposure positions and transfer positions of the photosensitive drums of the respective colors. Accordingly, adjustment of timings of the STRB signals as in the normal image-forming output process is unnecessary in the neutralization process.

Meanwhile, it is necessary to expose entire surfaces of the photosensitive elements 109 to light in the neutralization process. For this reason, in the neutralization process, the light-emission control section 123 does perform total light quantity regulation as described above but causes all the LEDs that are targets of light-emission control, to emit light at each timing such as that illustrated in FIGS. 8(*a*) and 8(*b*).

If the LEDAs 130 associated with the plurality of photosensitive drums 109 are caused to emit light concurrently in this condition where total light quantity regulation is not performed, an amount of electric current required at this instant becomes considerably large. As a result, a power source unit of a capacity appropriate for this large amount of electric current becomes necessary. To solve this problem, the present embodiment has a feature that timings of light emission from the LEDAs 130 associated with the photosensitive drums are differentiated in the neutralization process.

Figure 10:
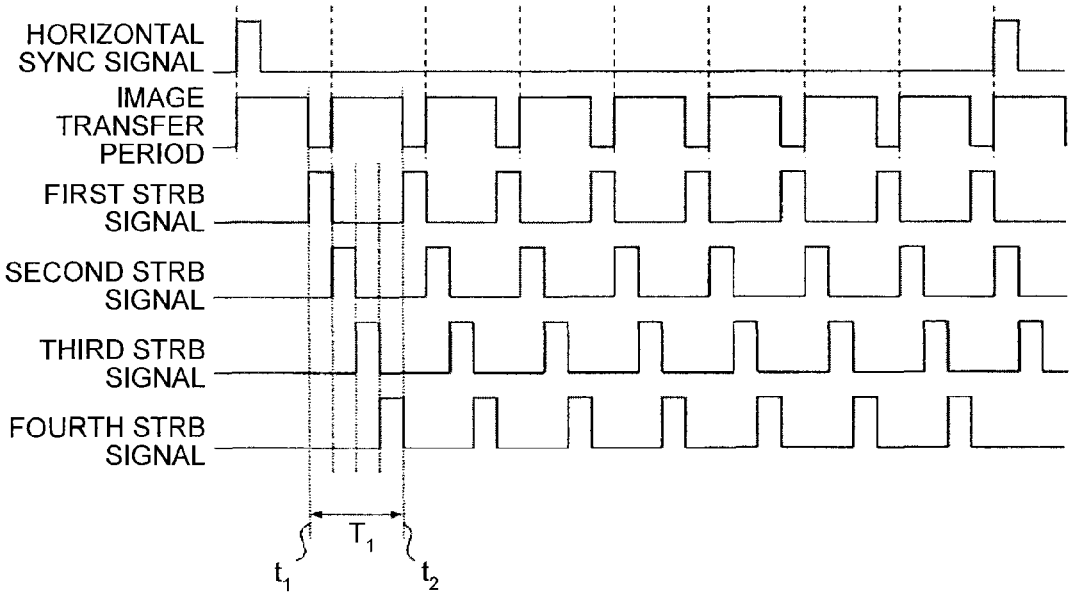
FIG. 10 is a timing diagram of timings when light is emitted from the LEDAs in a neutralization process according to the embodiment.

FIG. 10 is a timing diagram of timings when light is emitted from the LEDAs 130 in the neutralization process according to the present embodiment. As in a case of light emission timing control in the normal image-forming output process described above with reference to FIG. 6, light-on/off control is performed with the sub-cycle period that is one eighth of the cycle period of the horizontal synchronization signal, in the neutralization process. An image signal for use in the neutralization process is a signal to cause all the LEDs 131 to light up, and supplied from the neutralization control section 124 to the light-emission control section 123.

As illustrated in FIG. 10, a light-up duration corresponding to one sub-cycle period is a period $T_1$ between time $t_1$ at which transfer of one image signal is completed and time $t_2$ at which transfer of a subsequent image signal is completed. In other words, the period $T_1$ illustrated in FIG. 10 is a period during which light-on/off control according to input pixel data can be performed. In the neutralization process, the light-emission control section 123 generates first to fourth STRB signals each of which goes high over corresponding one of four sub-periods, into which the period $T_1$ illustrated in FIG. 10 is divided, to cause the LEDAs 130Y, 130C, 130M, and 130BK to light up, respectively. The neutralization control section 124 sets such timings for this light-on/off control.

Over a course where this light-on/off control is repeatedly performed by an amount corresponding to one turn of the photosensitive drums 109, the entire surfaces of the photosensitive drums 109 are exposed to light. As a result, remaining electrical charge is neutralized. When this light-on/off control is employed, because a situation where two or more of the LEDAs 130 light up concurrently does not occur, flow of an electric current as large as in a case where two or more of the LEDAs 130 light up currently does not occur. Therefore, a power source unit of a capacity appropriate for the large electric current becomes unnecessary, and the apparatus can be constructed of less expensive components.

As described above, timing control of STRB signals as in the normal image-forming output process is unnecessary in the neutralization process. If the light-on/off control is performed in a condition where timings of STRB signals are controlled as in the normal image-forming output process, timings of the STRB signals for the LEDAs 130 of the respective colors illustrated in FIG. 10 are shifted according to a control amount and thus two or more of the LEDAs 130 may be undesirably lit up concurrently. Therefore, it is necessary in the neutralization process to perform light-on/off control without performing timing control that is performed in a normal image-forming output process for registration of the toner images of the respective colors.

As described above, the optical writing device 120 according to the present embodiment performs light-on/off control of causing each of the LEDAs 130 to light up in one of the four sub-periods into which a single period during which light-on/off control can be performed is divided when the optical writing device 120 performs exposure of the photosensitive drums 109 for neutralization in the neutralization process, thereby preventing a situation where the four LEDAs 130 are lit up concurrently. This light-on/off control allows reducing a maximum amount of electric current necessary for the neutralization process performed by an optical writing device that performs exposure of photosensitive elements using light-source element arrays each made up of a plurality of light-source elements.

In the above embodiment, an example is explained where the photosensitive drums 109 are rotated one turn while the light-on/off control is performed with timings illustrated in FIG. 10. However, in the neutralization process according to the present embodiment, a period over which the LEDs 131 are to be lit up in one light-on/off control cycle is restricted to one fourth of a period during which light-on/off control can be performed, to limit the number of the LEDs 131 that are lit up currently. Accordingly, there can be a case where amounts of exposure of the photosensitive drums 109 are insufficient. In such a case, sufficient neutralization of the photosensitive drums 109 can be achieved by rotating the photosensitive drums 109 two or three turns.

When a neutralization process is performed by rotating the photosensitive drums 109 multiple turns, a scheme of rotating the photosensitive drums 109 four turns and dedicating each full turn to exposure of one of the photosensitive drums 109 is conceivable. However, this scheme undesirably requires rotating the photosensitive drums 109 multiple turns corresponding to number of the photosensitive drums 109. When this scheme is applied to the present embodiment, four turns are required. In contrast, in the neutralization process according to the present embodiment, a neutralization process can be completed with two or three turns if amounts of exposure of the photosensitive drums 109 become sufficient. Accordingly, time necessary for a neutralization process can be reduced.

A scheme of decreasing a rotation speed of the photosensitive drums 109 to ensure a sufficiently long exposure period can be employed in a case where the photosensitive drums 109 are exposed to light insufficiently with the one-fourth period, inspite of the scheme of rotating the photosensitive drums 109 two or three turns. To implement this scheme, the neutralization control section 124 makes operation settings of not only the light-emission control section 123 but also of a controller that controls rotations of the photosensitive drums 109.

In the above embodiment, an example is explained where, as illustrated in FIG. 10, a period during which light-on/off control can be performed is divided into four sub-periods and each of the LEDAs 130 is lit up for neutralization in one of the sub-periods, thereby limiting a maximum amount of electric current to an amount of electric current necessary for lighting up the single LEDA 130. In other words, in this control, a period during which light-on/off control can be performed is divided into sub-periods number of which corresponds to number of the LEDAs 130 and each of the LEDAs 130 is lit up in one of the sub-periods.

However, applicable control scheme is not limited thereto. If it is possible to use a power source unit of a capacity capable of supplying an amount of electric current necessary for lighting up two of the LEDAs 130, a control scheme of dividing a period during which light-on/off control can be performed into two sub-periods and lighting up every two of the LEDAs 130 in one of the sub-periods can be employed. This control scheme can also avoiding passage of electric current as large as in a case where all the LEDAs 130 are lit up concurrently.

Thus, an essence of the present embodiment lies in that the period $T_1$ illustrated in FIG. 10 is divided into sub-periods and each of the plurality of LEDAs 130 is caused to light up in any one of the sub-periods so as to always place at least one of the plurality of LEDAs 130 in a light-off state, thereby reducing an amount of electric current required at a time.

In the above embodiment, an example is explained where the neutralization process is performed on all of the four photosensitive elements. However, the neutralization process is performed to neutralize remaining electrical charge from the photosensitive drums 109 after completion of a print job. Accordingly, neutralization is unnecessary for the photosensitive drum(s) 109 that is not used in a image-forming output process.

Therefore, it is preferable to perform neutralization only on the photosensitive drum(s) 109 used in a print job but not to perform neutralization on the photosensitive drum(s) 109 unused in the print job. Accordingly, a neutralization process can be optimized by adjusting a manner of dividing the period $T_1$ illustrated in FIG. 10 according to an image formed by a print job.

Preferably employed for this optimization is a control scheme of setting exposure periods of the LEDAs 130 by dividing a period from completion of input of one image signal to completion of input of a subsequent image signal during which period light-on/off control can be performed, into sub-periods number of which corresponds to number of the photosensitive drums 109 on which neutralization is to be performed rather than into four sub-periods. This control scheme makes it possible to lengthen an exposure period of the LEDA 130, thereby ensuring a sufficiently long exposure period without rotating the photosensitive drums 109 multiple turns or decreasing rotation speed of the photosensitive drums 109 as described above.

This setting that depends on number of the photosensitive drums 109 on which neutralization is to be performed is also to be made by the neutralization control section 124. More specifically, the neutralization control section 124 recognizes which one(s) of the photosensitive drums 109 has been used in the print job, and inputs, to the light-emission control section 123, operation setting data to set a light-on/off control period and the photosensitive drum(s) 109 to be lit, depending on number of the photosensitive drums 109 having been used. By employing this control scheme, control as described above can be achieved.

Examples where this control scheme is applicable include a neutralization process performed after black-and-white printing. Black-and-white printing is performed using only the photosensitive drum 109BK for black. In this case, neutralization is to be performed only on the photosensitive drum 109BK, and light-on/off control is to be performed only on the LEDA BK. Accordingly, equal division of a period during which light-on/off control can be performed as described above is not performed, but the whole of every period during which light-on/off control can be performed is used to light up the LEDA 130BK.

In such a neutralization process only for one color as in this case, light-on/off control is not performed on the LEDAs 130 associated with the other photosensitive drums 109. Accordingly, control to prevent a situation where two or more of the LEDAs 130 light up concurrently is unnecessary. Therefore, it is preferable to perform a neutralization process only for one color without canceling timing control for the STRB signals performed in the normal image-forming process, thereby reducing processing load.

In the above embodiment, an example is explained where a period during which light-on/off control can be performed is equally divided. Alternatively, the light-up periods of the LEDAs 130 of the respective colors can be individually adjusted. For example, a control scheme of assigning a long light-up period to one of the LEDAs 130 for a color with which a large number of pixels are colored in the print job performed at S903, while assigning a short light-up period to one of the LEDAs 130 for a color with which a small number of pixels are colored, can be employed.

This control scheme can be implemented, for example, by counting, by the neutralization control section 124, number of colored pixels in pixel data that is input from the image-data acquiring section 122 to the light-emission control section 123, and controlling a manner of dividing the period $T_1$ illustrated in FIG. 10 depending on a result of the counting. This operation scheme makes it possible to optimize an exposure process performed for neutralization.

According to an embodiment, reduction in a maximum amount of electric current necessary for a neutralization process in an optical writing device that performs exposure of photosensitive elements using light-source element arrays each made up of a plurality of light-source elements can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device configured to form electrostatic latent images on a plurality of photosensitive elements, the optical writing device comprising:

a plurality of light sources, each of the plurality of light sources including a plurality of light source elements arranged in an array, and being configured to form an electrostatic latent image on a corresponding one of the plurality of photosensitive elements;

an image-data acquirer that acquires image data, the image data being data about an image to be formed as the electrostatic latent image; and a light-source controller that performs light-emission control on the plurality of light sources based on pixel data generated from the acquired image data, and performs a neutralization process to neutralize electrical charge on the corresponding one of the plurality of photosensitive elements by controlling the plurality of light sources to expose the corresponding one of the plurality of photosensitive elements to light, wherein during the neutralization process, the light-source controller divides a period during which light-on/off control can be performed on the plurality of light sources into sub-periods based on the pixel data input to the light-source controller, and causes a corresponding group of the plurality of light source elements of each of the plurality of light sources to be lit in a corresponding sub-period, while other groups of the plurality of light source elements of each of the plurality of light sources are maintained in a light-off state in said corresponding sub-period.

2. The optical writing device according to claim 1, wherein during the neutralization process, the light-source controller divides the period during which the light-on/off control can be performed into the sub-periods, a number of the sub-periods corresponding to a number of groups of the plurality of light source elements of each of the plurality of light sources, and causes the plurality of light sources to be lit in a manner that the corresponding group of the plurality of light source elements of each of the plurality of light sources is lit in said corresponding sub-period.

3. The optical writing device according to claim 1, further comprising a neutralization-process-operation setter, wherein the corresponding one of the plurality of photosensitive elements rotates relative to a corresponding light source of the plurality of light sources, so that the electrostatic latent image is formed on a surface of the corresponding one of the plurality of photosensitive elements, and the neutralization-process-operation setter sets a first rotation speed of the corresponding one of the plurality of photosensitive elements during the neutralization process to be slower than a second rotation speed of the corresponding one of the plurality of photosensitive elements in a normal image-forming output process.

4. The optical writing device according to claim 1, wherein the light-source controller performs the neutralization process after completion of an image-forming output process, and controls a manner of dividing the period during which the light-on/off control can be performed according to the image having been output in the image-forming output process.

5. The optical writing device according to claim 4, wherein the light-source controller controls a manner of dividing the period during which the light-on/off control can be performed during the neutralization process depending on a number of colored pixels in respective pieces of the pixel data, each of the pieces of the pixel data having been generated for a corresponding one of the plurality of light sources in the image-forming output process.

6. The optical writing device according to claim 4, wherein the light-source controller performs the neutralization process only on a photosensitive element used in the image-forming output process among the plurality of photosensitive elements.

7. An image forming apparatus comprising an optical writing device, the optical writing device configured to form electrostatic latent images on a plurality of photosensitive elements, and comprising:

a plurality of light sources, each of the plurality of light sources including a plurality of light source elements arranged in an array, and being configured to form an electrostatic latent image on a corresponding one of the plurality of photosensitive elements;

an image-data acquirer that acquires image data, the image data being data about an image to be formed as the electrostatic latent image; and a light-source controller that performs light-emission control on the plurality of light sources based on pixel data generated from the acquired image data, and performs a neutralization process to neutralize electrical charge on the corresponding one of the plurality of photosensitive elements by controlling the plurality of light sources to expose the corresponding one of the plurality of photosensitive elements to light, wherein during the neutralization process, the light-source controller divides a period during which light-on/off control can be performed on the plurality of light sources into sub-periods based on the pixel data input to the light-source controller, and causes a corresponding group of the plurality of light source elements of each of the plurality of light sources to be lit in a corresponding sub-period, while other groups of the plurality of light source elements of each of the plurality of light sources are maintained in a light-off state in said corresponding sub-period.

8. A method of controlling an optical writing device configured to form electrostatic latent images on a plurality of photosensitive elements, wherein the optical writing device includes:

a plurality of light sources, each of the plurality of light sources including a plurality of light source elements arranged in an array, and being configured to form an electrostatic latent image on a corresponding one of the plurality of photosensitive elements;

an image-data acquirer that acquires image data, the image data being data about an image to be formed as the electrostatic latent image; and a light-source controller that performs light-emission control on the plurality of light sources based on pixel data generated from the acquired image data, and performs a neutralization process to neutralize electrical charge on the corresponding one of the plurality of photosensitive elements by controlling the plurality of light sources to expose the corresponding one of the plurality of photosensitive elements to light, and the control method comprises:

during the neutralization process, dividing a period during which light-on/off control can be performed on the plurality of light sources into sub-periods based on the pixel data input to the light-source controller; and causing a corresponding group of the plurality of light source elements of each of the plurality of light sources to be lit in a corresponding sub-period, while other groups of the plurality of light source elements of each of the plurality of light sources are maintained in a light-off state in said corresponding sub-period.

* * * * *